US005565061A

United States Patent [19]

Salminen

[11] Patent Number: 5,565,061

[45] Date of Patent: Oct. 15, 1996

[54] METHOD AND APPARATUS FOR REMOVING SCALES DEPOSITED ON THE STRAINER OF A PULP DIGESTER

[76] Inventor: Reijo Salminen, 373 Cove Rd., Bellingham, Wash. 98226

[21] Appl. No.: 259,508

[22] Filed: Jun. 14, 1994

[51] Int. Cl.[6] ..... D21C 7/14

[52] U.S. Cl. ..... 162/48; 162/251

[58] Field of Search ..... 162/17, 41, 43, 162/48, 199, 77, 90, 251

[56] References Cited

U.S. PATENT DOCUMENTS

| | | | |
|---|---|---|---|
| 2,003,347 | 6/1935 | Dreyfus | 92/9 |
| 2,845,347 | 7/1958 | Byrne | 162/48 |
| 3,589,521 | 6/1971 | Richter | 162/251 |
| 4,496,426 | 1/1985 | Baumeister et al. | 162/19 |
| 5,116,475 | 5/1992 | Edlund et al. | 162/52 |
| 5,366,592 | 11/1994 | Ford | 162/198 |

FOREIGN PATENT DOCUMENTS

| | | |
|---|---|---|
| 4272288 | 9/1992 | Japan . |

*Primary Examiner*—Donald E. Czaja
*Assistant Examiner*—Dean T. Nguyen
*Attorney, Agent, or Firm*—Robert B. Hughes

[57] ABSTRACT

A wood pulp digester comprising a containing structure defining a digesting chamber in which wood chips and processing liquor are contained under pressure. Liquor is moved from a liquor removal region in the digester through a strainer. Periodically a cleaning solvent is directed under pressure in a counterflow direction through the strainer to remove scaling that may tend to accumulate on the strainer.

12 Claims, 3 Drawing Sheets

METHOD AND APPARATUS FOR REMOVING SCALES DEPOSITED ON THE STRAINER OF A PULP DIGESTER

The present invention relates to wood pulp processing and specifically to an apparatus and method for the digester of a pulp mill. More specifically, the present invention relates to such a method and apparatus which permits greater flexibility in the composition of the liquor used in the digester by providing a system for the removal of scaling that would otherwise form on the strainers of the digester when certain compositions of the liquor are used with certain types of wood chips.

BACKGROUND OF THE INVENTION

In the pulp processing industry, wood chips are introduced into a digester where these are treated under high pressure and temperature by a liquor that is introduced into the digester to break down the lignin and sugar content of the wood fibers, leaving only the cellulose. During the digesting process, the liquor is drawn out of the digester at various locations and recirculated to other locations in the digester. So that the wood chips remain in the digester, it is necessary that the liquor that is being removed passes through a strainer which has slot like openings that prevent the passing of wood chips but permit the passage of the liquor therethrough.

If the screens in the digester become clogged, then it is commonly necessary to shut down the digester and remove the scaling from the strainers. Such a shutdown can be extremely costly, and make it economically unfeasible to operate the pulp mill in that manner. Quite commonly this problem is alleviated by formulating the composition of the liquor so that certain components of the liquor will prevent the formation of the scaling on the strainers.

This formulation will depend to some extent on the species of the wood from which the chips are made. For example, if the wood has a high percentage of pitch, the scaling would quite possibly be more of a problem. An example of this is in a digester which uses alcohol (either ethyl or methyl alcohol) as one of the major components of the liquor. If soft wood is being treated in the digester, there is more of a tendency for scaling to form. However, the addition of sodium hydroxide to the liquor composition substantially alleviates the scaling problem.

The further treatment of the black liquor resulting from the digester process is also an important part of the operation of a pulp mill. In order to operate a pulp mill economically, it is generally necessary to process or utilize the black liquor in some manner to extract value therefrom. This can be done in various ways. Generally, the black liquor goes to an evaporator where a substantial portion of the water content is removed. Then the residue from the black liquor can be burned to generate heat energy which is utilized in other parts of the pulp mill and to recover the non-organic chemicals in the liquor for recirculation in the pulping process. Alternatively, the residue remaining after the evaporation of the black liquor can be utilized in other applications, such as producing adhesive for particle board or animal food pelletizing.

SUMMARY OF THE INVENTION

In view of the foregoing, it is the principle object of the present invention to provide method and apparatus for a digester in a pulp processing system which is able to alleviate the problem of the formation of scaling on the strainers of the digesters to allow more flexibility in the formulation of the composition of the digesting liquor. One specific advantage of the present invention can in some instances result in enabling the black liquor to be utilized in a manner which could be more profitable.

A specific application of the present invention is to be utilized in a digester using ethyl or methyl alcohol as the main active ingredient of the digesting liquor, while processing wood chips (such as wood chips from soft woods) which are prone to cause clogging of the strainers.

The pulp digester comprises a containing structure defining a digesting chamber. There is inlet means to introduce wood chips and digesting liquor into the digesting chamber.

There is at least one liquor extraction means at an extraction region of the digester. The liquor extraction means comprises a strainer means positioned in the digester to receive an outflow of liquor through said strainer means and prevent entry of wood chip products through said strainer means. There is also a collector means to receive the liquor that passes from the digester through the strainer.

There is solvent means to selectively direct a solvent under pressure in a counterflow direction to pass through said strainer means in a direction opposite to flow of liquor through said strainer means while said liquor and said wood chips are in said digester under pressure. Thus, the digester is able to continue operation, while solvent can selectively and periodically be passed through said strainer means to remove accumulation of scaling on said strainer means.

In a preferred form, the digester comprises means to withdraw solvent from said collector means to recirculating tank means and to recirculate solvent back to said solvent means for subsequent use.

Also in the preferred form, there is means to direct pressurized steam to evacuate the collector means at least partially of liquor, and means to selectively direct the solvent under steam pressure to and through the strainer means.

In the method of the present invention, a digester is provided as noted above. Solvent under pressure is selectively directed in a counterflow direction to pass through the strainer means, as described above.

Other features will become apparent from the following description.

DESCRIPTION OF THE PREFERRED EMBODIMENT

Figure 1:
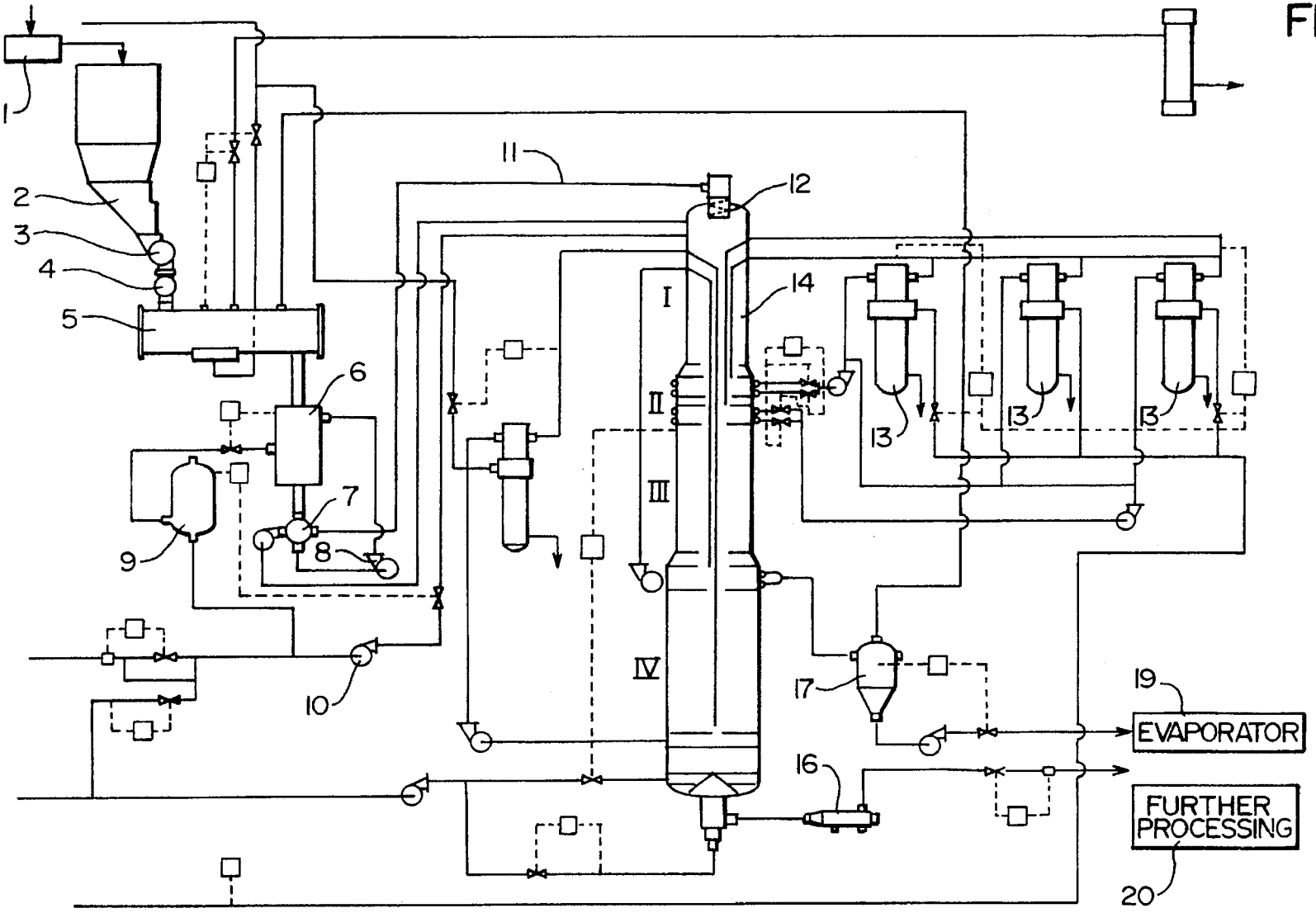
FIG. 1 is a somewhat schematic drawing illustrating a digesting portion of a prior art pulp processing system in which the present invention can be effectively utilized.

It is believed that a clearer understanding of the present invention will be obtained by first reviewing the digesting portion of a typical pulp mill for which the present invention is particularly adapted. With reference to FIG. 1, the wood chips are first subjected to magnetic separation of tramp iron and screening at location 1, and then directed into a surge bin of a hopper indicated at 2. From the hopper, the chips flow into a chip meter 3 which controls the rate of flow of the chips which then pass into a low pressure feeder 4.

The feeder 4 directs the chips into a steaming vessel 5 that is kept at between 15 to 20 PSI where the chips are pre-steamed. The chips are then directed from the steaming vessel 5 into the chip chute 6, from which the chips move to a high pressure feeder 7. The chips are flushed into the feeder by means of a chip chute circulating pump 8. As seen in FIG. 1, the flow from the pump 8 into the chip chute 6 and to the feeder 7 is in a counterclockwise direction. Make up liquor for the chip chute 6 is derived from the level tank 9. The wood chips mixed with a certain amount of liquor are then moved from the feeder 7 through a line 11 into a top strainer 12 to the top of the digester 14. A high pressure pump 10 introduces the cooking liquor to the digester, as well as the excess liquor from the chip chute. The volume of the cooking liquor can be controlled by a magnetic flow meter.

In general, the digester pressure is controlled so as to be at about 165 PSI. The chips and the cooking liquor gradually move downwardly in the digester, first passing into an upper impregnation zone I and then to the heating zone II.

The temperature is raised in two steps by two cooking circulating systems, which comprise extraction strainers, pumps and central circulating chambers. Three heaters 13 are shown. After heating, the chips and liquor pass downwardly through the cooking zone III of the digester. As the chips then pass into the lower washing zone IV of the digester, extracted wash liquor is circulated through the chips to provide a quench of the cooking reaction. The chips continue to pass downwardly in the washing zone IV, then to be discharged. The entire sequence is arranged so that the duration of the digesting process is about one and one half to four hours.

Wash liquor from a subsequent filter tank or fresh hot water is pumped into the bottom of the digester and flows upwardly countercurrently to the chip flow. Elevated temperatures of 125° to 135° C. are controlled in the diffusion zone by an auxiliary wash liquor circulation and heater system.

At various locations in the digester, the liquor is recirculated to an upper location. A portion of the liquor that is extracted between zone III and zone IV is directed to a flash tank 17, and thence to flash heat evaporators. The pulp that is extracted from the bottom of the digester is directed to a blow unit 16 which has a pressure reducing function, and then further directed to a brown stock washer or to some other location for further processing. Eventually the black liquor developed during the digesting process is directed to an evaporator 19, for further processing as indicated schematically at 20.

Since the section of the wood pulp processing system shown in FIG. 1 (and also the entire pulp processing operation which would be compatible with the digesting section shown in FIG. 1) are well known in the prior art, these will not be described in detail any further. It is to be understood that to the extent that the novel components of the present invention cooperate advantageously with the other components or sections with the entire pulp processing operation, such components are deemed to be part of the disclosure of the present invention. For example, the present invention can result in an advantageous further use of the components derived from the black liquor, and as will be disclosed more fully later herein, this may permit the black liquor to be used in the manner that the lignin and other components derived from the wood fiber can advantageously be used for example, as a glue, binder, or constituent of other products such as panels, animal feed, etc.

Figure 2:
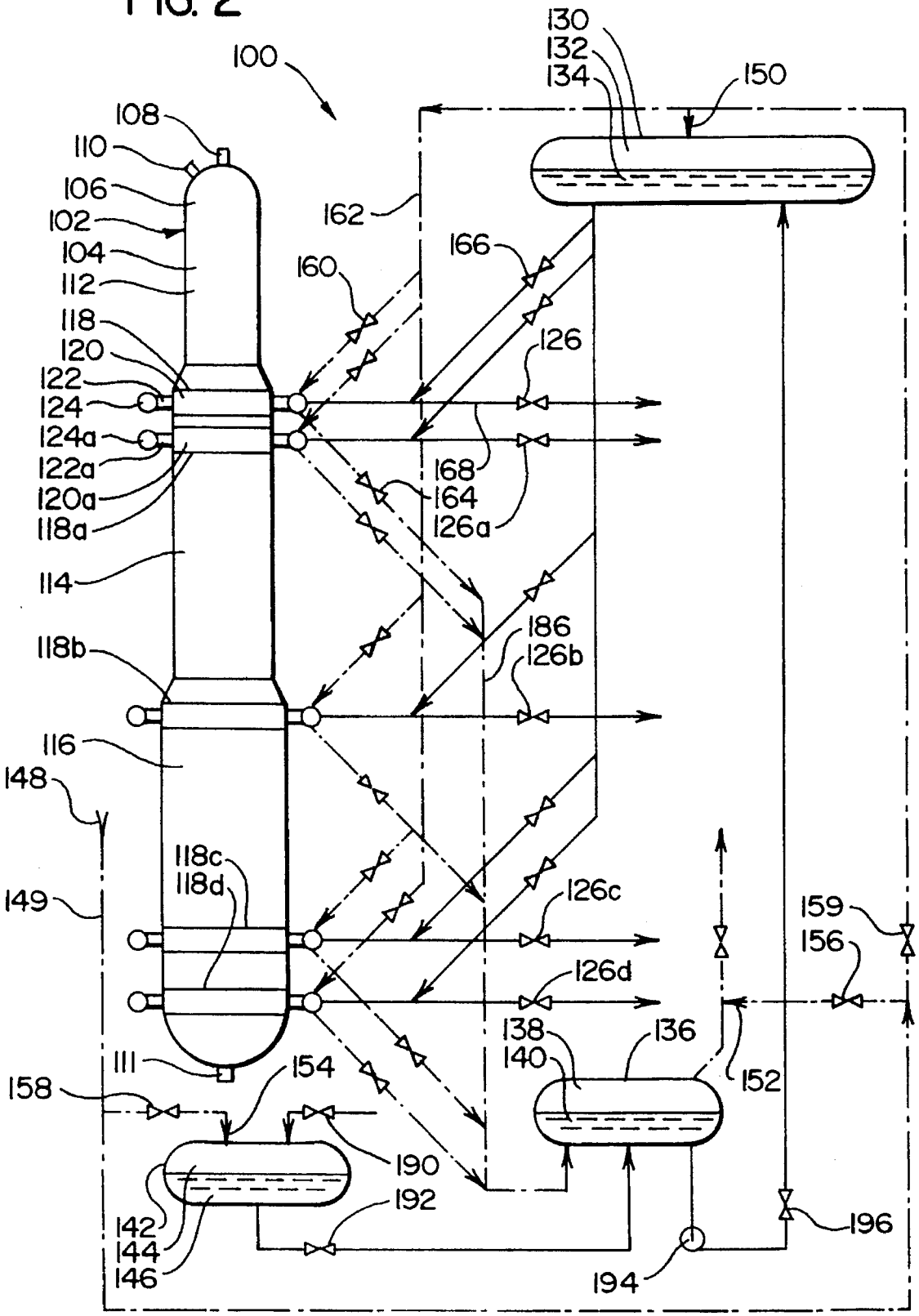
FIG. 2 is a semi-schematic view showing a pulp digester, such as that shown in FIG. 1, incorporating the teaching of the present invention in a pulp processing system similar to that shown in FIG. 1.

FIG. 2 shows the digester system 100 of the present invention, comprising a digester 102 which is, or may be, similar in overall construction of the prior art digester as shown at 14 in FIG. 1. This digester 102 comprises a vertically aligned containing structure 104, also called a tower, having an upper end 106 into which wood pulp is directed through an intake opening schematically shown at 108, and into which processing liquor is introduced at 110 (also shown schematically). A pulp outlet is shown schematically at 111. As shown herein, the digester has an upper section 112 of smaller diameter, an intermediate section 114 of a moderately increased diameter, and a lower section 116.

At the lower end of the upper section 112 there is a first liquor extraction area 118 where there is a cylindrically shaped strainer 120 through which the liquor passes to discharge passageways 122 and thence into a surrounding tubular structure 124 which has a donut like configuration. (It is to be understood that these components 120, 122, and 124 are shown rather schematically herein, and these could take different forms. For example, the tubular liquor collecting structure 124 could be positioned within the digester wall, and other arrangements and configurations could be provided.) In the particular arrangement shown herein, there are four more extraction areas 118 at various vertical locations, each having the strainer 120, extraction passageways 122 and tubular collection structure 124. These other extraction regions 118, are given numerical designations 118, 120, 122 and 124 with letter suffixes "a", "b", "c" and "d" distinguishing the other extraction areas 118 and the components associated therewith.

It is also to be understood that the digester 120 is being shown schematically, and other apparatus and components would be utilized. For example, there would be at the lower end of the digester 102, means for possibly introducing wash water or other liquid possibly for changing the temperature, diluting the pulp slurry for subsequent processing or other purposes. Also components such as shown in FIG. 1 would likely be utilized as components for use with the present invention.

There is for each extraction area 118 a related discharge valve 126, and these valves 126 are also given letter suffixes indicating which of the extraction areas 118 these are associated. Most of these valves 126 direct the liquor in a recirculating pattern so that the liquor may be introduced back into the digester at a higher location. The extraction valve **126*b* (and/or possibly another valve or valves 126**) may, depending upon other processing functions, lead the liquor directly to the evaporator.

All of the components 102 through 126 which have been described thus far are or may be, rather similar to or the same as in a typical prior art digester, such as shown at 14 in FIG. 1. In fact, one of the benefits of the present invention is that the system of the present invention can quite advantageously be incorporated into an existing digester, such as shown in FIG. 1. From this point on, the components of the digester system 100 described in the following text with reference to FIG. 2 are those which are newly added as part of the present invention.

There is a solvent tank 130 having in the upper portion of the tank 130 a steam region 132 containing high pressure steam that is at a pressure higher than the operating pressure inside the digester 102. In the lower part of the solvent tank 130 there is a section containing a solvent composition 134. There is also a solvent recirculating tank 136 having an upper high pressure steam region 138 and a lower solvent containing region 140, and also a third solvent tank which is a solvent makeup tank 142, having an upper steam region 144 and a lower solvent region 146. There is a source of high pressure steam indicated at 148, leading into a steam line 149 that communicates with each of the aforementioned solvent tanks 130, 136 and 142 through steam inlets 150, 152, and 154, respectively. The inlets 152 and 154 each have control valves 156 and 158, respectively, and another valve 159 is provided in the line 149 upstream of the steam inlet 150.

The system of the present invention will first be described with reference to the upper liquor extracting area 118. There is a steam inlet valve 160 which leads from the steam line portion 162 into the uppermost tubular container 124, and a solvent outlet valve 164 leading from the container 124.

Also, there is for the first liquor extraction region 118 a solvent supply valve 166 leading from the lower solvent region of the tank 130, and into a discharge line 168 which leads from the tubular container 124 to the liquor discharge valve 126.

In this preferred embodiment, let it be assumed that the digesting liquor has as its primary digesting ingredient alcohol (either ethyl or methyl). In the prior art, when ethyl or methyl alcohol is used as the primary digesting ingredient, if certain types of wood are being processed (e.g. wood chips made from soft wood), the reaction of the liquor with the wood chips is such as to be more prone to cause scaling to form on the strainer 120.

Figure 3:
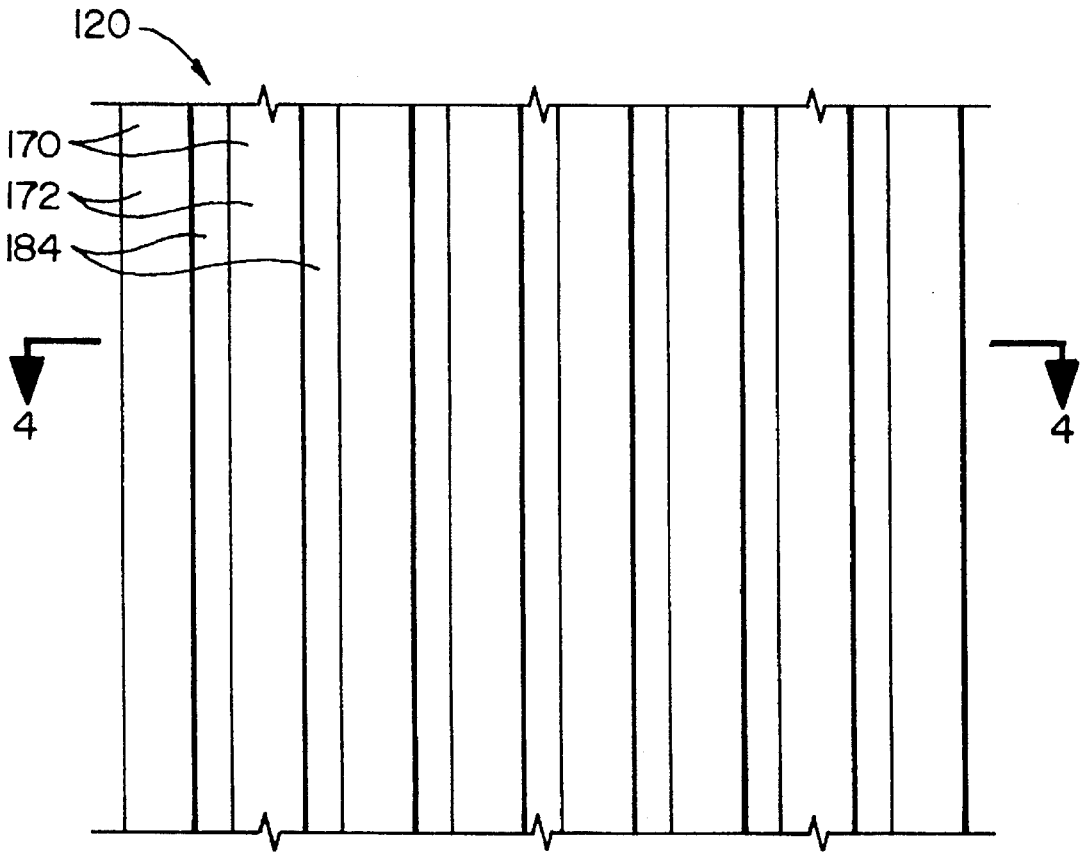
FIG. 3 is an elevational view looking toward the interior face of a portion of a strainer utilized in the present invention.
Figure 4:
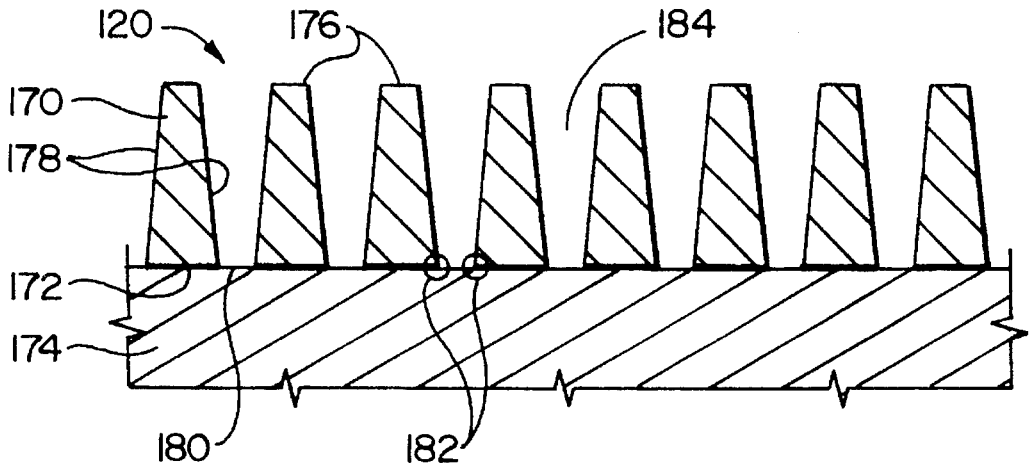
FIG. 4 is a sectional view taken along lines 4—4 of FIG. 3.

With reference to FIGS. 3 and 4, which show a portion of the strainer 120, it can be seen that the strainer 120 comprises a plurality of elongate metal strainer elements 170, each having a front or inner face 172, facing the pulp slurry 174 and a back face 176. In cross section, each strainer element 170 has converging sidewalls 178 which converge from the wider upstream face 172 to the smaller downstream face 176. The openings 180 defined by adjacent front surfaces 172 could be, for example, 1/16th of an inch in width.

The deposit of the scaling generally occurs at the front edge portions of the front faces 172, such as circled at 182. In prior art alcohol based digester systems, the deposit of scaling on the screen elements 170 is substantially inhibited (if not substantially eliminated) by formulating the liquor so that it contains an adequate amount of sodium hydroxide (NaOH) to prevent the scaling. When this is done, the spent liquor (i.e. black liquor) that is removed from the digester (or from washers later on in the pulp processing) is commonly processed so as to isolate the sodium hydroxide (and possibly other processing chemicals) for reuse in the digesting system. This is commonly done by first evaporating a substantial portion of the water from the black liquor and then burning the concentrated black liquor so that the useful chemicals can be extracted from the remaining residue.

To describe the process of the present invention, there is used an alcohol based liquor where either ethyl or methyl alcohol is used as the primary digesting ingredients. The formulation for the white liquor has little, if any, sodium hydroxide. Thus, it would be expected that after a relatively short period of operation, possibly one or two weeks, the screens 120, 120*a*, etc. would become clogged due to the deposit of scaling. To alleviate this, the following process is performed in the present invention. This process in general involves frequent periodic solvent applications for the strainers 120, 120*a* etc. sequentially.

The first step is to open the steam valve 160 to direct the high pressure steam into the tubular container 124. At this time, the liquor discharge valve 126 is open. The effect of this high pressure steam is to drive part of this liquor out of the tubular container 124 back into the digester 102, and also to drive the rest of the liquor through the recirculating valve 126, which at this time remains open. This valve 126 conventionally recirculates the liquor back through a heater to the top of the digester 102.

When the tubular container 124 is substantially empty of liquor, then the valve 126 is closed. The solvent supply valve 166 is opened to direct solvent 134 from the solvent region in the tank 130 to the tubular containing structure 124 so that, with the solvent at 134 being at the pressure of the steam 132, the solvent fills the tubular container 124 and passes into the digester 102 to flow inwardly through the passageways 184 in the strainer 120 a short distance and to some extent into the pulp slurry 174. In this particular embodiment, the solvent at 134 has as its main ingredient (or at least as one of its main ingredients) sodium hydroxide which dissolves any small amount of scaling that might have accumulated at the critical edge locations 182 of the strainer elements 170. Since the solvent moves through the entire tubular container 124, it passes through the strainer 120 around the entire circumference thereof.

After a period of time (e.g. five to ten minutes,) the valve 166 is closed and the valve 164 is opened to drain the solvent in the tubular container 124 downwardly through a line 186 to the lower region 140 of the recirculating tank 136. During this time, the valve 160 remains open so that most of the solvent is driven from the tubular container 124 down to the recirculating tank so as to essentially empty the tubular container 124. When this is completed, the valve 160 is closed, the valve 164 is closed, and the valve 126 is opened so that the liquor from the digester 102 flows outwardly from the digester to the valve 126 to be recirculated back to the digester.

Thus, it can be seen that periodically, for a short period of time, a certain portion of solvent is circulated from the tank 130 to the container 124 and in a counterflow direction through the strainer 120 to cause removal of what scaling may have accumulated in the previous time period (e.g. possibly two hours or so, which is an approximate time between sequential cleaning operations). A certain amount of this solvent will remain in the pulp within the digester, near the sidewalls of the digester, and this will simply flow downwardly with the pulp. This small amount of solvent would not have any substantial effect on the overall digesting process and subsequent processes in the pulp mill.

After the descaling operation has been completed at the upper recirculating region 118, then the very same process is done with respect to each of the other recirculating regions 118*a*, 118*b*, etc., in sequence. Since substantially the same sequence is followed as is described above, this will not be repeated relative to the recirculating region 118*a–d*.

As solvent is used, it will be necessary to take solvent from the makeup tank 142. The makeup tank 142 is desirably provided with solvent in a batch operation. To accomplish this, the steam valve 158 and the solvent discharge valve 192 would be closed, and the makeup valve 190 opened to direct the make-up solvent into the tank 142. Then the valve 190 is closed, and the steam valve 158 and valve 192 are opened to direct the solvent from the region 146 over to the recirculating tank 136.

To recirculate the solvent that has been collected in the tank 136, there is provided a pump 194 that directs the solvent through a valve 196 back to the tank 130.

It can be seen that with the present invention, the strainers 120, 120*a*, etc., by being cleaned by solvent for short periods at frequent intervals, can be maintained substantially free of scaling for continuous operation of the pulp mill. With very little sodium hydroxide introduced into the liquor, this opens various avenues for other uses of the spent black liquor other than burning it for recovery of the sodium hydroxide and other chemicals. The alcohol which is used as the main digesting ingredient and which remains in the liquor can be recycled through evaporation, and the residue from the black liquor could advantageously be put to uses other than fuel. As indicated previously, this could be used as a binder or ingredient for various products, such as structural panels, animal feed, or other uses.

It is to be understood that while sodium hydroxide has been described for a preferred ingredient for the solvent, and while the present invention is particularly well adapted for use in an alcohol digesting system, within the broader scope of the present invention, there could be modifications and applications of the present invention with other materials which would be such as to be suitable for or compatible with, the main operating features of the present inventions.

What is claimed:

1. In a method of operating a pulp digester which comprises:

a. a containing structure defining a digesting chamber;

b. inlet means to introduce wood chips and digesting liquor into said digesting chamber;

c. at least one liquor extraction means at an extraction region of said digester, said liquor extraction means comprising:

i. a strainer means positioned in said digester to receive an outflow of liquor through said strainer means and prevent entry of wood chip product through said strainer means;

ii. a collector means to receive the liquor that passes from said digester through said strainer;

iii. a liquor discharge means leading from said collector means;

the improvement comprising:

a. opening pressurized steam valve means for directing pressurized steam into said collector means to substantially displace all of the liquor in said collector means;

b. closing liquor discharge valve means to isolate said liquor collector means from said liquor discharge means and directing an inflow of solvent through solvent inlet valve means into said collector means under pressure to cause solvent to flow from said collector means through said strainer means for a period of time;

c. opening solvent outlet valve means to permit solvent in said collector to flow outwardly through solvent outlet means;

d. opening said liquor discharge valve means while closing said pressurizing steam valve means and said solvent outlet valve means to permit a flow of liquor through said strainer means into said collector means and through said liquor discharge means;

whereby said digester is able to continue operation, while solvent can selectively and periodically be passed through said strainer means to remove accumulation of scaling on said strainer means.

2. The method as recited in claim 1, wherein said inflow of solvent is directed from a solvent supply tank means defining a solvent chamber to contain solvent in one part of said chamber and pressurized steam in another part of said chamber, whereby said solvent is driven by the pressurized steam in the chamber through the solvent inlet valve means to the collecting means.

3. The method as recited in claim 1, wherein said strainer means has a straining area through which the liquor flows, and said collector means communicates with said strainer means so that substantially the entire straining area communicates with said collector means so that said solvent flows through substantially the entire straining area.

4. The digester as recited in claim 1, wherein each of said liquor discharge valve means, said solvent inlet valve means, said solvent outlet valve means, and said steam pressurizing valve means are arranged to be operated independently of one another to accomplish proper sequence of operation.

5. The method as recited in claim 1, wherein solvent is directed from a solvent tank defining a solvent chamber which contains solvent and pressurized steam to force solvent through the solvent inflow valve means, and a recirculating tank in communication with said solvent outflow means to redirect said solvent to said solvent tank, said steam pressurizing said solvent tank and said recirculating tank.

6. The method as recited in claim 1, wherein the solvent is directed through said strainer means into the digester to move into the pulp slurry in the digester.

7. The method as recited in claim 1, wherein said solvent comprises sodium hydroxide.

8. A pulp digester, comprising:

a. a containing structure defining a digesting chamber;

b. inlet means to introduce wood chips and digesting liquor into said digesting chamber;

c. at least one liquor extraction means at an extraction region of said digester, said liquor extraction means comprising:

i. a strainer means positioned in said digester to receive an outflow of liquor through said strainer means and prevent entry of wood chip product through said strainer means;

ii. a collector means to receive the liquor that passes from said digester through said strainer means;

d. a liquor discharge means leading from said collector means and comprising liquor discharge valve means to control flow of liquor from said collector means through said liquor discharge means;

e. solvent inflow means to selectively direct solvent under pressure into said collector means and comprising solvent inflow valve means to selectively control flow of solvent under pressure into said collector means;

f. solvent outlet means leading from said collector means to receive solvent from said collector means and comprising solvent outlet valve means to selectively direct solvent from said collector means and through said solvent outlet means;

g. steam pressurizing means to direct pressured steam into said collector means, and comprising steam pressurizing valve means to selectively control flow of pressurized steam into said collector means;

wherein said digester is operated so that accumulation of scaling can be removed from said strainer means by:

i. opening said steam pressurizing valve means to direct steam into said collector means to displace liquor from said collector means and closing said liquor discharge valve means;

ii. opening said solvent inflow valve means to direct solvent into said collector means and to cause a flow of said solvent means through said strainer means to remove scaling from said strainer means;

iii. operating said steam pressurizing valve means to cause pressurized steam to flow into said selector means and also opening said solvent outlet valve means to cause solvent in said collector means to flow through said solvent outlet means;

iv. opening said liquor discharge valve means with said steam pressurizing valve means and said solvent outlet valve means being closed to permit a flow of liquor through said strainer means into said collector means and through said liquor discharge means; and whereby said digester is able to operate continuously, while solvent can selectively and periodically be passed through said strainer means to remove accumulation of scaling on said strainer means.

9. The digester as recited in claim 8, wherein said solvent inflow means comprises a solvent supply tank means defining a solvent chamber to contain solvent in one part of said chamber and pressurized steam in another part of said chamber, whereby said solvent is driven by the pressurized steam in the chamber through the solvent inflow valve means to the collecting means.

10. The apparatus as recited in claim 8, wherein said strainer means has a straining area through which the liquor flows, and said collector means communicates with said strainer means so that substantially the entire straining area communicates with said collector means so that said solvent flows through substantially the entire straining area.

11. The digester as recited in claim 8, wherein each of said liquor discharge valve means, said solvent inflow valve means, said solvent outlet valve means, and said steam pressurizing valve means are arranged to be operated independently of one another to accomplish proper sequence of operation.

12. The digester as recited in claim 8, wherein there is a solvent tank defining a solvent chamber which contains solvent and pressurized steam to force the solvent in the chamber through the solvent inflow valve means, and a recirculating tank to receive solvent from said solvent outflow means and redirect said solvent to said solvent tank, said steam pressurizing said solvent tank and said recirculating tank.

* * * * *